United States Patent [19]

Martin et al.

[11] 4,000,879

[45] Jan. 4, 1977

[54] PUSHING OR PULLING APPARATUS FOR PIPE, ROD OR THE LIKE

[75] Inventors: James Scott Martin, Perry; Robert E. Cook, Orlando, both of Okla.

[73] Assignee: The Charles Machine Works, Inc., Perry, Okla.

[22] Filed: Oct. 23, 1974

[21] Appl. No.: 517,393

[52] U.S. Cl. ..... 254/29 R

[51] Int. Cl.[2] ..... E21B 19/00

[58] Field of Search ..... 254/29–31

[56] References Cited

UNITED STATES PATENTS

| | | | |
|---|---|---|---|
| 1,489,253 | 4/1924 | Hyotlaine et al. | 254/29 R |
| 2,517,494 | 8/1950 | Kiss et al. | 54/29 R |
| 2,681,789 | 6/1954 | Nichols | 254/29 R |
| 2,807,494 | 9/1957 | Buffer | 254/29 R |
| 2,866,662 | 12/1958 | Nemeth | 254/29 R |
| 2,935,298 | 5/1960 | Wilwerding | 254/29 R |
| 3,645,502 | 2/1972 | Stromp | 254/29 R |
| 3,807,695 | 4/1974 | Gremillian et al. | 254/29 R |

*Primary Examiner*—Al Lawrence Smith
*Assistant Examiner*—Robert C. Watson

[57] ABSTRACT

Apparatus for pushing or pulling a pipe, rod or the like through subterranean areas, such as beneath sidewalks, roadways, etc. It is lowered into a pit and braced against opposing walls thereof by jacking out an extensible frame. Once positioned within the pit, a motor and pump unit supplies hydraulic fluid under pressure to a hydraulic cylinder which reciprocates through a lever arm a gripping means slidably mounted on the frame. When moved in one direction, the gripping means grips the pipe or rod while when moved in the other direction it disengages from the pipe or rod. The pipe or rod is thereby driven longitudinally into the ground. To pull the pipe or rod, the gripping direction of the gripping means is reversed by shifting the gripping member.

9 Claims, 9 Drawing Figures

FIG. 6
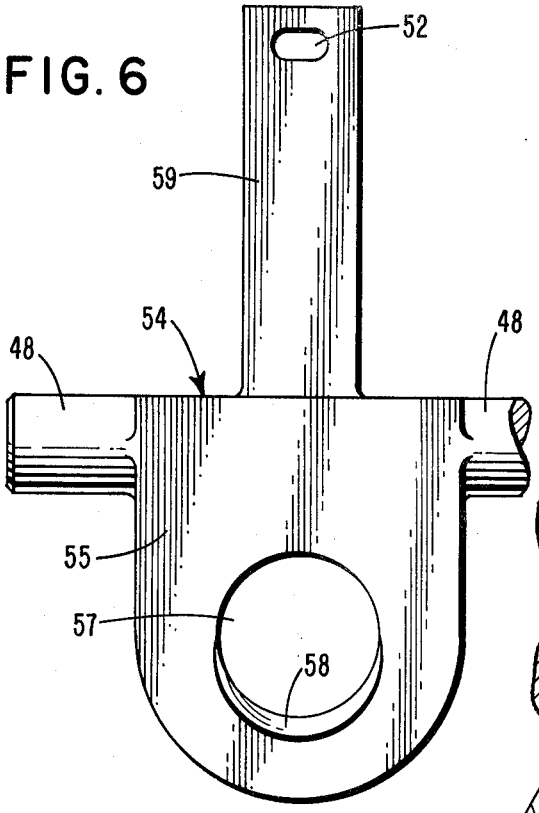
FIG. 7
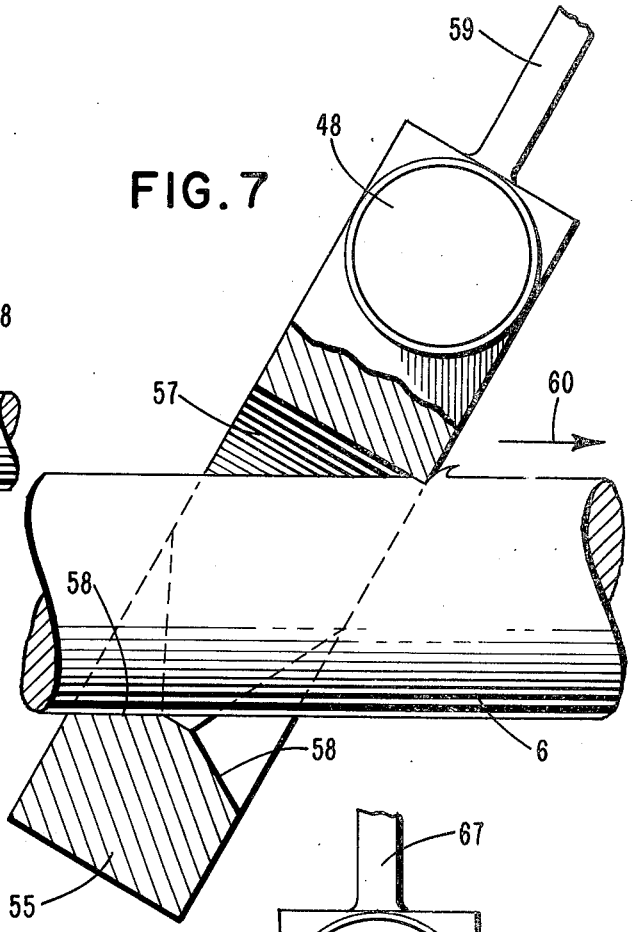
FIG. 8
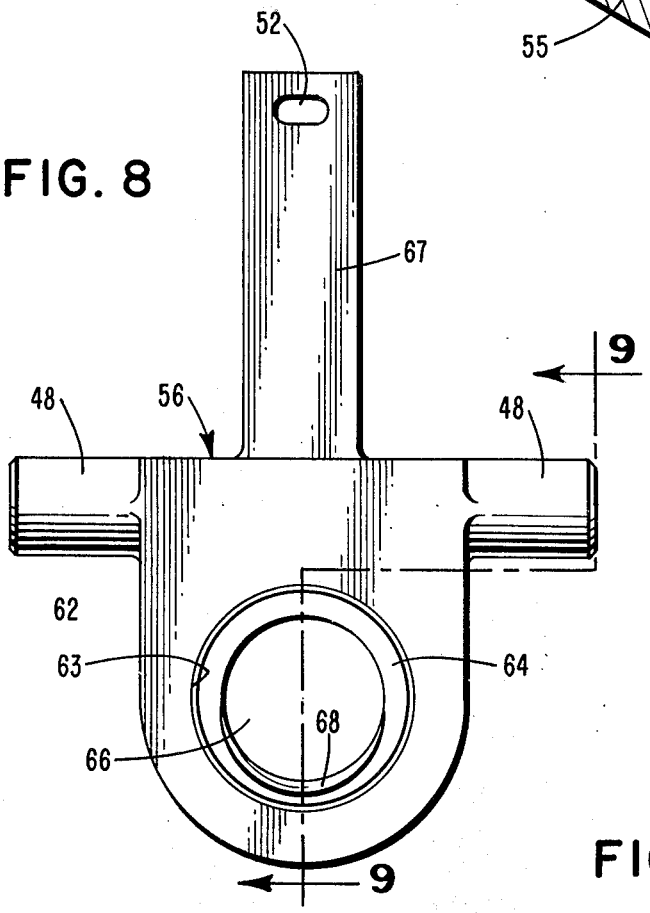
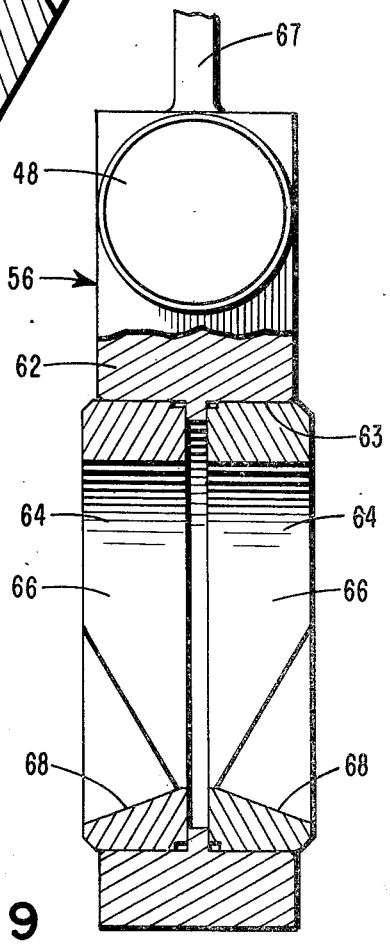
FIG. 9

PUSHING OR PULLING APPARATUS FOR PIPE, ROD OR THE LIKE

BACKGROUND OF THE INVENTION

This invention relates to a pipe or rod pushing and pulling apparatus useful for driving pipes, rods, or the like through the earth. It is particularly useful in laying pipelines or other conduits beneath paved highway surfaces because it avoids the necessity of digging up the ground surface to form a trench, with the resulting need for backfilling the earth and repaving the highway or sidewalk.

Known pipe pushing devices are generally anchored to the ground on which they rest, which often provides insufficient footing for driving pipes long distances through the earth. For this reason, it has been found advantageous to brace the pipe pusher against a wall or other reasonably stationary object.

Known pipe pushing devices of the type designed to be operated in subterranean pits have generally required a person to enter the pit during initial set-up to anchor the apparatus prior to operation. This necessitates an unreasonably large pit in the regions of the anchor points, which is unnecessary during operation of the apparatus.

Pipe pushers not designed to be anchored to the ground, such as those to be lowered from a boom, while avoiding the above problem, do not achieve the secure footing provided by anchored devices. Instead they are attached to mobile boom supports which are less easily aimed and are limited in depth of operation. Such devices are generally mounted on land vehicles, which may be impossible to use due to terrain conditions, adjacent buildings or other obstructions.

THE PRESENT INVENTION

The disadvantages of the prior art are eliminated or minimized in the present invention. It comprises an extensible frame adapted to be mounted within a subterranean pit by exerting pressure against opposite walls of the pit. Such pressure is exerted by hydraulic means, which may be controlled by an operator outside the pit. A gripping means is slidably moved along the frame in a reciprocating fashion and grips the pipe or rod in one direction of movement, but disengages from driving the pipe or rod when moved in the other direction. Such gripping direction of movement is reversible, to allow pulling of the pipe or rod without the necessity of turning the apparatus around within the pit. The mechanism used to move the gripping means relative to the frame is also hydraulic and may also be conveniently controlled from outside the pit.

Accordingly, a principal object of this invention is to provide an apparatus securely mountable under hydraulic pressure within a subterranean pit to push or pull a pipe, rod or the like.

Another object of this invention is to provide a pipe or rod pushing or pulling apparatus having a frame which may be extended by remote control from outside the pit to secure itself within a subterranean pit.

Another important object of this invention is to provide an improved subterranean pipe or rod pushing or pulling apparatus in which the pipe gripping means is hydraulically reciprocated, through a lever arm, longitudinally relative to the apparatus frame and engages and grips the pipe or rod while being moved in one direction, but disengages the pipe or rod while being moved in the other direction.

Another object of this invention is to provide an improved subterranean pipe or rod pushing or pulling apparatus in which the direction in which the pipe or rod is pushed or pulled is readily reversible.

Another object of this invention is to provide an improved pipe pushing apparatus having gripping members which reduce the deformation of the pipe or rod to be pushed or pulled.

A still further object of this invention is to provide an improved pipe pushing apparatus having gripping members with increased durability.

This invention is designed to accomplish the above and related end results, and comprises elements and features hereafter set forth. Several illustrative embodiments of the present invention are described below in relation to the annexed drawings of the same. It is to be understood that these illustrative embodiments suggest only a few of the various ways in which the principles of this invention may be employed.

BRIEF DESCRIPTION OF THE DRAWINGS

FIG. 6 is a front view of a preferred embodiment of a gripping member for the reversible gripping means shown in FIG. 4;

FIG. 7 is a side view, partially broken away, of the gripping member of FIG. 6 shown drivingly associated with a rod;

FIG. 8 is a front view of another preferred embodiment of a gripping member for the reversible gripping means shown in FIG. 4; and FIG. 9 is an enlarged side view, partially broken away, of the gripping member of FIG. 8.

DESCRIPTION OF ILLUSTRATIVE EMBODIMENTS

Figure 1:
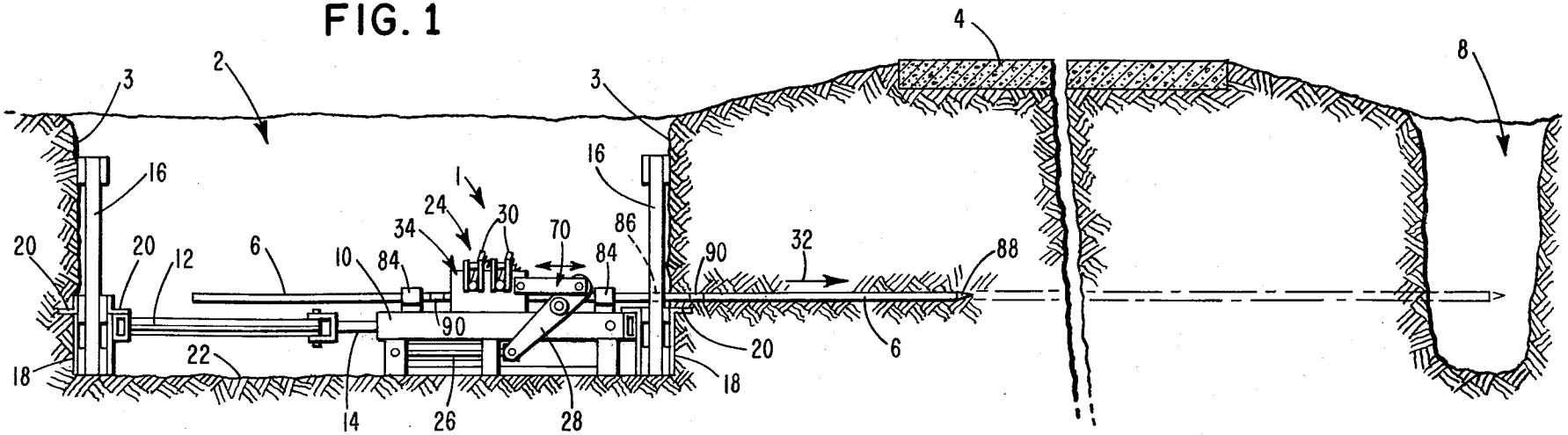
FIG. 1 is a side elevation view of an illustrative embodiment of the apparatus invention, shown installed in a subterranean pit for pushing a pipe or rod under a roadway.

Referring to FIG. 1 it can be seen that, in its preferred form, the apparatus 1 is designed for pushing or pulling an elongated member 6 such as a pipe, rod or the like, through a subterranean area. It is adapted to be mounted in a pit 2 which has substantially vertical opposed walls 3 against which the apparatus 1 can be braced. In laying a pipeline under a roadway 4, the apparatus 1 is preferably positioned such that the member 6 is pushed toward a target pit or trench 8. In this way member 6 may be placed beneath a roadway 4 without the necessity of digging a trench and disturbing the roadway paving.

The apparatus 1 comprises a frame 10 having extensible means to engage opposed walls 3 of the pit 2. In the illustrative embodiments, the extensible means on the frame 10 comprises a jacking means 14 which is hydraulically extended to brace the apparatus against the walls 3 of the pit 2 into which it has been lowered. The apparatus may easily be lowered into the pit on suspending chains (not shown) and held at the desired depth in the pit until the jacking means 14 has been extended to fix the apparatus in the pit 2 between opposed walls 3. Hydraulic fluid is provided to the jacking means 14 in any conventional manner from an external hydraulic fluid pressure source (not shown). An extension 12 is connected to the end of jacking means 14 to extend out to adjacent the rear wall 3 of pit 2. This extension 12 allows successive lengths of pipe or rod members 6 to be connected longitudinally of each other as the pushing operation progresses.

Interposed between the opposed walls 3 of the pit 2 and the frame 10 are pit shoring members 16. Each pit shoring member 16 has a cleated face 18 for engaging a pit wall 3, which serves to inhibit movement of such member 16 during operation of the apparatus 1. In the preferred embodiment, cleats 20 are provided by horizontal ribs formed on both sides of the shoring members 16.

Once the apparatus 1 has been lowered into the pit 2, and properly positioned, the frame 10 is extended by jacking means 14 and extension 12 to engage opposed walls 3 of the pit 2 with sufficient pressure to retain the apparatus 1 in its desired operating position within pit 2. It is within the contemplation and design of this invention that pressure exerted by the extensible means 14 on the frame 10 against the pit walls 3 through shoring members 16 will be sufficient to suspend the apparatus 1 above the floor 22 of the pit 2. As such, it is unnecessary for the apparatus to be positioned as shown in FIG. 1, but may, as circumstances of use dictate, be suspended above the floor 22 of the pit during operation.

Figure 2:
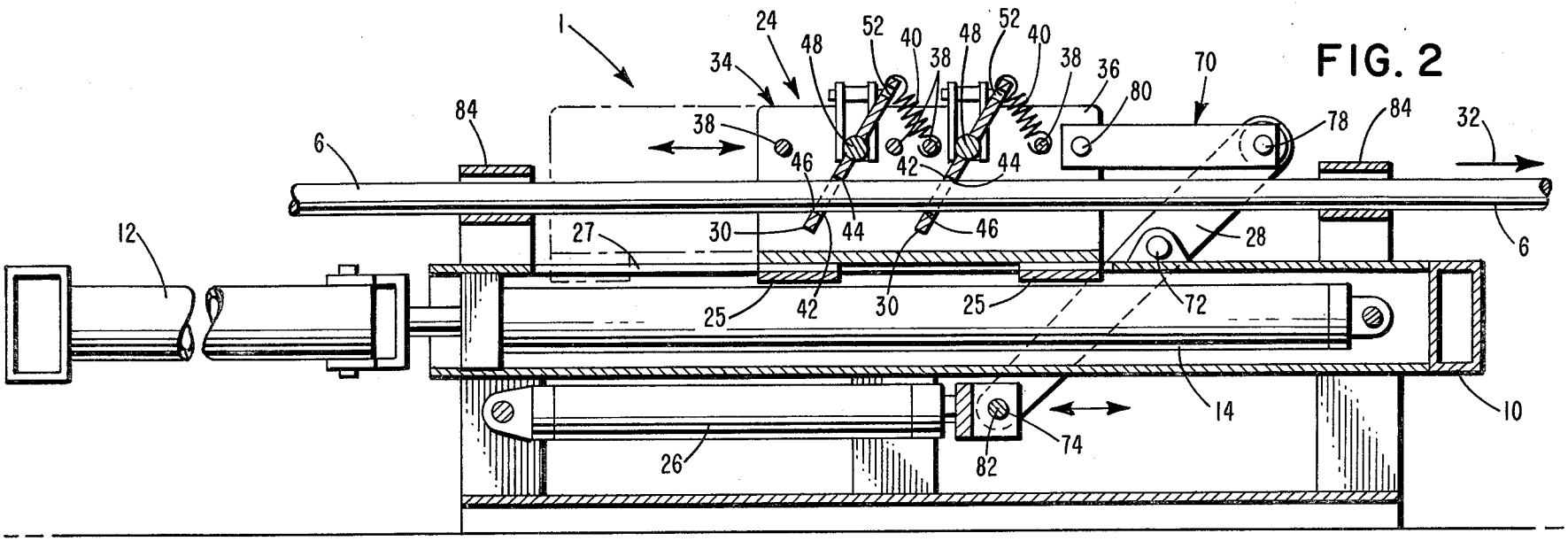
FIG. 2 is a side sectional view of the apparatus of FIG. 1.
Figure 5:
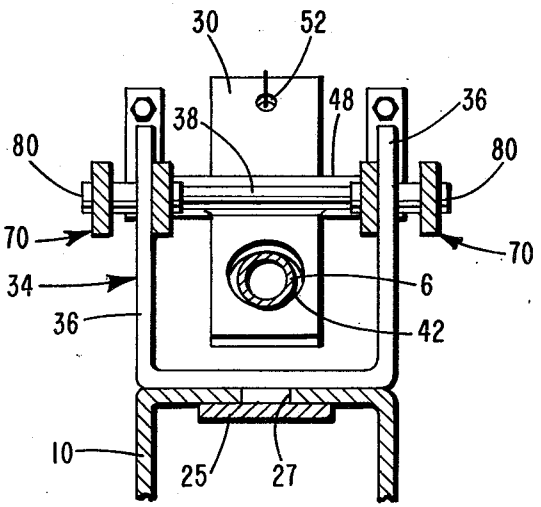
FIG. 5 is a sectional view taken on line 5—5 of FIG. 4.

Mounted on the frame 10 is a reversible gripping means 24, which is cooperable with the elongated member 6 to grip and move the member 6 in either direction. Mounting within the gripping means 24 is at least one gripping member 30, described below, which serves to grippingly engage the member 6 when moved longitudinally relative to the frame 10. As can be seen in FIG. 2, the reversible gripping means 24 is slidably mounted on the frame 10 and is reciprocated thereon by means of a hydraulic cylinder 26 and pivoting lever arm 28, further described below. In the illustrative embodiments, the slidable mounting comprises a pair of downwardly extending members 25 with a cross-section shaped like an inverted T, as shown in FIG. 5. These members 25 serve as guides which ride in a long groove 27 running longitudinally along the top of the frame 10.

In the first illustrative embodiment, two gripping members 30 serve to grip the member 6. The gripping members 30 grippingly engage when the gripping means 24 is moved in one direction, and disengage the elongated member 6 when moved in the opposite direction. The gripping members 30 are shiftable to reverse the gripping direction, as described below. As shown in FIG. 2, the gripping members 30 are oriented so as to engage the pipe only when the gripping means 24 is moved in the direction of the arrow 32.

The reversible gripping means 24 includes two parallel vertical plates 36 forming a housing 34 which surrounds the elongated member 6 and pivotally support gripping members 30. Attached between the housing plates 36 are a plurality of cross members 38 which serve as anchors for the retention springs 40 described below. The gripping members 30 are pivotally mounted on shafts 48 extending between the housing plates 36.

Such gripping members 30 are formed from substantially flat plates each with an opening 42 therein for passage of the member 6 therethrough. Gripping engagement is provided between edge portions 44 and 46 of the opening 42 and the member 6 by virtue of the angular relation between the gripping member 30 and the member 6. When the housing 34 is moved in the direction of the arrow 32, as seen in FIG. 2, positive gripping engagement of the elongated member 6 occurs. When the housing 34 is moved in the opposite direction, the member 6 is disengaged from the gripping members 30 and thus the elongated member 6 is consequently not pushed or pulled.

Figure 4:
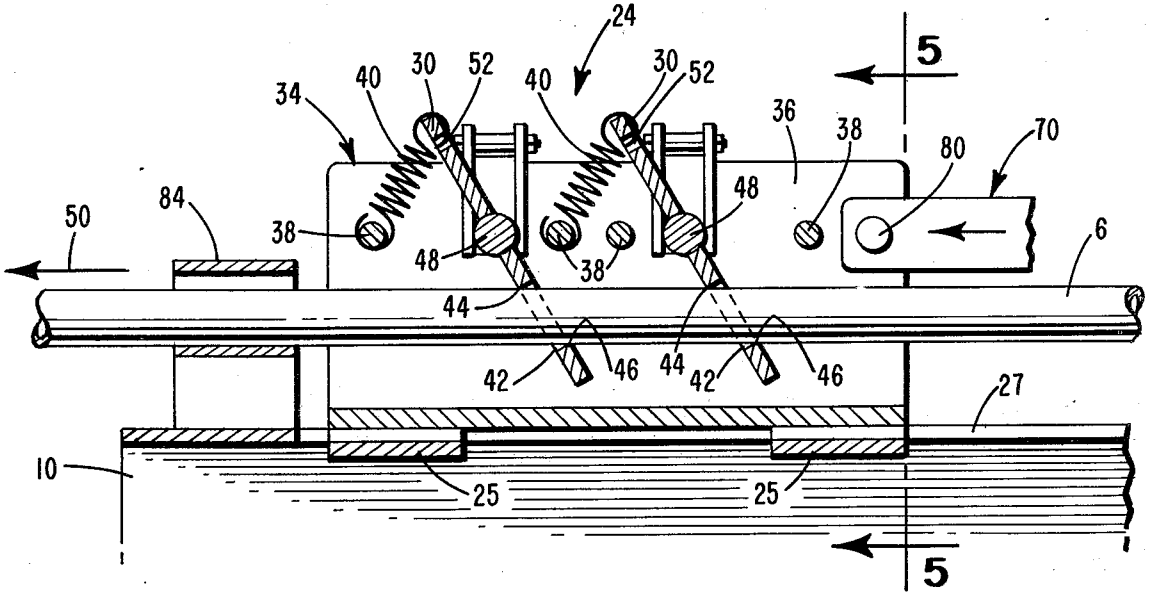
FIG. 4 is an enlarged side sectional view of the reversible gripping means of the apparatus, broken away to show the gripping members and their retention springs.

The direction in which the pipe or rod member 6 is to be pushed or pulled is conveniently reversible by virtue of the pivotal mounting through shafts 48 which carry the gripping members 30. These pivotal mounting shafts 48 permit the gripping members 30 to be shifted to an angular relation with the elongated member 6 which is substantially reversed. In such reversed orientation, substantially similar positive gripping engangement is provided between the gripping members 30 and the member 6, but in a direction of movement opposite to that preceding such shift. FIG. 2 shows the gripping members 30 in one angular relation with the pipe or rod member 6, with the gripping direction shown by the arrow 32. In FIG. 4 the angular relation between the gripping members 30 and the member 6 is substantially reversed and the direction of positive gripping engagement is opposite to that in FIG. 2, as shown by the arrow 50.

A gripping member retention means is used to retain the gripping members 30 in one or the other angular relation to the pipe or rod member 6. Such retention means is most preferably resilient to permit the gripping members 30 to pivot slightly while maintaining their orientations, although the necessary freedom of movement can be provided by a non-resilient pin, clip or other analogous means with sufficient yieldability. In the illustrative embodiments of this invention, the retention means used is a spring 40 attached to each gripping member 30 at a point 52 displaced from the pivot axis of the supporting shaft 48 and anchored to one of the housing cross members 38. Each spring 40 may be conveniently disconnected from the cross member 38 and reattached to the cross member 38 on the other side of the gripping member 30, to shift the gripping member 30 between the position in FIG. 2 to the position shown in FIG. 4. In this way the pipe or rod pushing or pulling direction of the apparatus 1 may be conveniently reversed.

Alternative illustrative and more preferred embodiments of the gripping member 30 within the scope of this invention are shown in FIGS. 6–9. These gripping members 54 and 56, demonstrate improved wear characteristics while cutting less deeply into the pipe or rod member 6, thus leaving it safer to handle and work with in use.

The gripping member 54, shown in FIGS. 6 and 7, comprises a substantially flat plate 55 with an opening 57 therein for the passage of the elongated member 6 therethrough. Opening 57 further has beveled edge portions 58 adjacent the opposite faces of plate 55 and remote from pivot support shaft 48. Designed to be used in exactly the same manner as the gripping member 30 described above, this gripping member 54 is pivotally mounted on a shaft 48 between the housing plates 36 and is maintained in an angular relation to the member 6 by a retention spring 40 as previously described for member 30. An angular relation substantially equivalent to that used with the gripping member 30 may be used. When in such an angular relation, the beveled edge portion 58 provides a surface of contact between the gripping member 54 and the pipe or rod member 6. This reduces strain on the lower portion of the gripping member 54 and minimizes cutting into the member 6 by the gripping member in use.

In FIG. 7, the angular relation is such that the gripping member 54 will push the member 6 when it is moved in the direction of the arrow 60. Such angular relation may be substantially reversed by pivoting the gripping member 54 in the manner described for the gripping members 30 above, thus providing gripping engagement with the member 6 in the opposite direction. As with the above embodiment, a retention means such as a spring 40 will maintain the gripping member 54 in its angular relation. Such spring 40, as in the first embodiment, is attached between the housing cross members 38 and the gripping member 54 at point 52 on extension arm 59. Such spring 40 is conveniently detachable to shift the gripping member 54, as described for gripping member 30 above.

A third preferred gripping member design 56, within the scope of this invention, is shown in FIGS. 8 and 9. It comprises a plate 62 with an opening 63 therein. In this embodiment at least one, and preferably two, insert members 64 are secured in the opening 63. Each insert member 64 has an opening 66 therein for passage of the elongated member 6 therethrough. When pivotally mounted between the housing plates 36, as in the first illustrative embodiment 30, the gripping members 56 of this illustrative embodiment perform exactly the same function as the gripping members 30 described above. Positive engagement is provided between the member 6 and edge portions of the openings 66 in the insert members 64 when the gripping member 56 is moved in a gripping direction, and disengaged when moved in the opposite direction. The insert members 64 serve to increase the durability of the gripping member 56 because such insert members can be made of wear-resistant and harder materials which would be too costly to use in manufacture of the entire gripping member 56.

Also as shown in FIGS. 8 and 9 the insert members 64 described above each have a beveled edge portion 68 of the opening 66 through the insert member 64. As in the embodiment of FIGS. 6 and 7, the beveled edge portions 68 lie adjacent the opposite faces of plate 62 and remote from the pivot shaft 48. Such beveled edge portions 68 provide the same type of surface contact between the gripping member 56 and the pipe or rod member 6 as does the second gripping member illustrative embodiment outlined above. In this embodiment, a surface of contact 68 is provided between one insert member 64 and the pipe or rod member 6 when the gripping member 56 is in one angular relation, and between the other insert member 64 and the member 6 when in the other. Such a disposition of beveled edges 68 provides substantially identical advantages as the second illustrative embodiment described above, particularly, preventing cutting into the pipe.

The apparatus incorporating gripping members as shown in FIGS. 8 and 9, discussed above, are used in the same manner as the other illustrative embodiments. As such, the gripping member 56 is pivotally mounted on shafts 48 extending between the housing plates 36. Retention means, such as a spring attached at 52 to the arm 67 and then releasibly attached to one of the cross members 38, permit selection of the desired angular relation to the pipe or rod member 6. Movement of the reversible gripping means 24 relative to the frame 10, causes the elongated member 6 to be pushed in the direction in which the gripping members 56 grip the elongated member 6.

Relative movement between the frame 10 and the reversible gripping means 24 is imparted by a hydraulic cylinder 26 attached to the frame 10 by pin 76 (FIG. 2). A lever arm 28 connected through a linkage 70 to the housing 34 of the gripping means 24 serves to transmit the extension and retraction movement of the cylinder 26 to the gripping means 24. The hydraulic cylinder 26, as shown in FIG. 2, is displaced from, but substantially parallel with, the line of movement of the gripping means 24 on the frame 10. The lever arm 28 is pivotally attached at 72 to the frame 10, thus transmitting the movement of the hydraulic cylinder 26 to the gripping means 24 by lever action, with the fulcrum at the pivot 72. A pivotal connection is provided at 74 between the arm 28 and the hydraulic cylinder 26. Similarly, linkage 70 is interposed between the upper end of lever arm 28 and the gripping means housing 34, with such linkage 70 being pivotally connected at 78 to the arm and to the housing 34 at 80. Hydraulic fluid pressure, applied to the hydraulic cylinder 26 from a conventional hydraulic fluid pump (not shown), external to the apparatus 1, causes the hydraulic cylinder 26 to extend and, by means of the lever arm 28 and the linkage 70, reciprocate the gripping means 24 relative to the frame 10. Hydraulic fluid pressure introduced to contract hydraulic cylinder 26 obviously reciprocates gripping means 24 in the opposite direction relative to frame 10.

Figure 3:
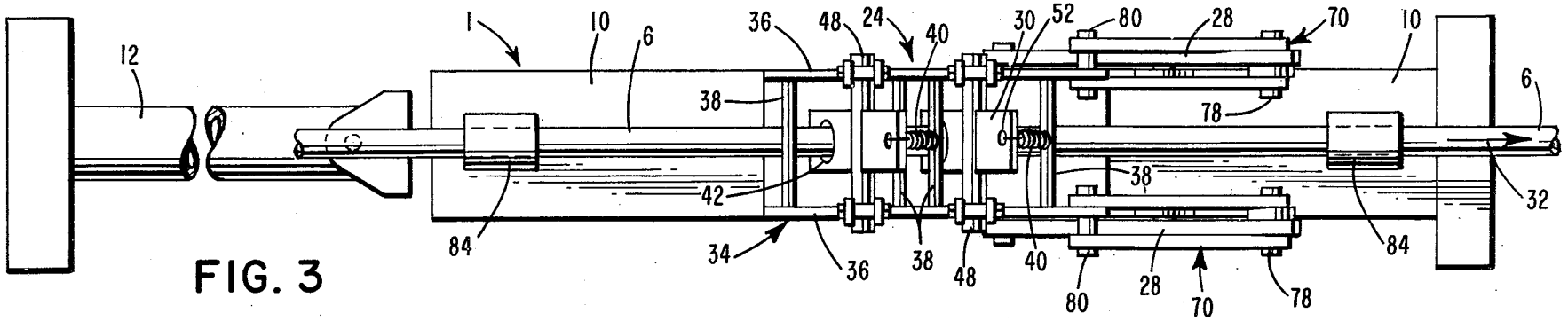
FIG. 3 is a top plan view of the apparatus shown in FIG. 2.

Preferred illustrative embodiments, best shown in FIG. 3, use a pair of such lever arms 28 and linkages 70 to transmit movement from the hydraulic cylinder 26 to the gripping means 24. A single hydraulic cylinder 26 is connected to both lever arms 28 at the pivotal connection 74 by a shaft 82 extending between the arms 28. The pairs of arms 28, pivotal mountings 72, and linkages 70 are the same in construction as described above and operate in parallel. Non-hydraulic mechanical means could be used to reciprocate gripping means 24 and such alternative means is deemed within the contemplated scope of this invention.

To operate the illustrative embodiments of the apparatus 1 of this invention, it is first necessary to position it within a pit 2. It is lowered into a subterranean pit 2 by any conventional means, such as by suitable ropes or chains attached to the frame 10. The frame 10 is then extended by means of the jacking means 14. Before the frame 10 is extended so as to touch the opposed walls 3 of the pit 2, pit shoring members 16 are positioned between the frame 10 and these walls 3. When sufficiently extended, the frame exerts pressure on the shoring members 16 which in turn engage the walls 3, as described above. When thus positioned, the apparatus 1 may be operated.

An elongated member 6, such as a pipe, rod or the like, is first inserted through one of the pipe supporting members 84, into the housing 34 and then through the gripping members 30; the gripping direction for pushing or pulling having been selected, as described above by appropriately connecting springs 40 to the proper cross members 38. The member 6 is then slid further through another supporting member 84. Such supporting members 84 serve to hold the member 6 in place prior to engagement with the ground and to aim the member 6.

Once fully in place, the elongated member 6 is driven into the pit wall 3 through an opening 86 in the shoring member 16, by the gripping action of the gripping means 24, described above. This occurs when the gripping means 24 is moved relative to the frame 10 in the gripping direction. To aid in the driving of the pipe 6 into the ground, the first such pipe may have pointed tip 88. Additional lengths of pipe or rod may be added in any conventional manner to permit the driving of the elongated member under a highway, sidewalk or the like. One such means for fastening additional lengths end to end together is shown in FIG. 1 wherein threaded couplings 90 serve to attach threaded pipe or rod ends together. It is understood that in any means, such as couplings 90, the coupling means will be small enough in diameter to be able to pass through the gripping members 30 and not hamper their function.

If a boring pipe, rod or the like is first pushed through the ground, it may be extracted by shifting the gripping members 30 to their reversed angular relation, and operating the apparatus 1 as before. The lengths of elongated members 6 are detached and removed as they are successively extracted. A final elongated member may then be pushed through the prebored hole.

Operation of the jacking means 14 and hydraulic cylinder 26 of this apparatus 1 may be conveniently controlled by an operator external to the pit 2. Hose connections between the hydraulically operated components 14 and 26, and a conventional source of hydraulic fluid under pressure are all that are needed to power the apparatus 1. These connections, as well as the motor driven pump unit, and valve control mechanism needed for an operator to control the apparatus 1, are conventional and form no part of the present invention.

Operation of the embodiments of the apparatus 1 which include the alternative gripping members 54 and 56 described above and shown in FIGS. 6–9 is as described above where gripping members 30 are used.

It will be appreciated that the embodiments of this invention herein described are illustrative only. They represent suggested forms of apparatus for achieving the objects and goals initially set forth. Accordingly, it will be understood that the embodiments set forth are not intended to exclude but rather to suggest such other modifications and adaptations as fall within the spirit and scope of this invention as defined in the appended claims.

We claim:

1. Apparatus for pushing or pulling an elongated member, such as a pipe, rod or the like, through a subterranean area comprising:

a frame adapted to be mounted within a subterranean pit and having extensible means to engage opposed walls of the pit to retain said frame in a desired operating position within the pit, said extensible means comprising a hydraulically extensible jacking means operable by pressurized hydraulic fluid supplied remote from said jacking means and remote from the subterranean pit for said frame to exert and maintain pressure against the opposed walls of the pit in fixing the apparatus during its operation;

reversible gripping means mounted on said frame to be cooperable with the elongated member and be movable longitudinally relative to said frame, said gripping means having a gripping member whereby the elongated member is grippingly engaged when said reversible gripping means is moved in a gripping direction and is disengaged when said gripping means is moved in an opposite direction relative to said frame, said gripping member being shiftable to reverse the gripping direction of said gripping means; and hydraulically extensible means connected between said frame and said reversible gripping means for imparting movement to said gripping means relative to said frame wherein pushing of the elongated member is effected when said reversible gripping means is moved in said gripping direction and pulling effected when said gripping member is shifted to reverse the gripping direction.

2. Apparatus as defined in claim 1 wherein said hydraulically extensible means connected between said frame and said reversible gripping means is connected to said reversible gripping means by a lever arm, said arm being pivotally attached to said frame intermediate the ends of said arm with said hydraulically extensible means being mounted in a position displaced from but substantially parallel with the line of movement of said reversible gripping means whereby the pushing and pulling force of said hydraulically extensible means is transmitted to said reversible gripping means by means of said pivoting lever arm.

3. Apparatus for pushing or pulling an elongated member, such as a pipe, rod or the like, through a subterranean area comprising:

a frame adapted to be mounted within a subterranean pit and having extensible means to engage opposed walls of the pit to retain said frame in a desired operating position within the pit;

reversible gripping means mounted on said frame to be cooperable with the elongated member and be movable longitudinally relative to said frame, said gripping means having a gripping member whereby the elongated member is grippingly engaged when said reversible gripping means is moved in a gripping direction and is disengaged when said gripping means is moved in an opposite direction relative to said frame, said gripping member being shiftable to reverse the gripping direction of said gripping means, said gripping member having an opening therein for passage of the elongated member therethrough, said gripping member being pivotally mounted to assume a first angular relation to the elongated member so as to provide positive gripping engagement between the elongated member and edge portions of said opening when said gripping member is moved in a gripping direction and disengage the elongated member when said gripping member is moved in the opposite direction, one of said edge portions of said opening being beveled so as to provide a surface of contact between said gripping member and the elongated member when said gripping member is in said first angular relation; and means for imparting relative movement between said frame and said reversible gripping means wherein pushing of the elongated member is effected when said reversible gripping means is moved in said gripping direction and pulling effected when said gripping member is shifted to reverse the gripping direction.

4. Apparatus for pushing or pulling an elongated member, such as a pipe, rod or the like, through a subterranean area comprising:

a frame adapted to be mounted within a subterranean pit and having extensible means to engage opposed walls of the pit to retain said frame in a desired operating position within the pit;

reversible gripping means mounted on said frame to be cooperable with the elongated member and be movable longitudinally relative to said frame, said gripping means having a gripping member whereby the elongated member is grippingly engaged when said reversible gripping means is moved in a gripping direction and is disengaged when said gripping means is moved in an opposite direction relative to said frame, said gripping member being shiftable to reverse the gripping direction of said gripping means, said gripping member having an opening therein for passage of the elongated member therethrough, said gripping member being pivotally mounted to assume a first angular relation to the elongated member so as to provide positive gripping engagement between the elongated member and edge portions of said opening when said gripping member is moved in a gripping direction and disengage the elongated member when said gripping member is moved in the opposite direction;

said pivotal mounting of said gripping member permitting it to be shifted to a substantially reversed second angular relation to the elongated member providing substantially similar positive gripping engagement between the elongated member and the edge portions of said opening in a direction of movement of said gripping member opposite to the direction in which said gripping engagement is provided by said gripping member in said first angular relation; and an edge portion of said opening being beveled so as to provide a surface of contact between said gripping member and the elongated member when said gripping member is in either of said first or second angular relation.

5. Apparatus for pushing or pulling an elongated member, such as a pipe, rod or the like, through a subterranean area comprising:

a frame adapted to be mounted within a subterranean pit and having extensible means to engage opposed walls of the pit to retain said frame in a desired operating position within the pit;

reversible gripping means mounted on said frame to be cooperable with the elongated member and be movable longitudinally relative to said frame, said gripping means having a gripping member whereby the elongated member is grippingly engaged when said reversible gripping means is moved in a gripping direction and is disengaged when said gripping means is moved in an opposite direction relative to said frame, said gripping member being shiftable to reverse the gripping direction of said gripping means, said gripping member having an opening therein with an insert member disposed in said opening, said insert member having an opening therein for passage of the elongated member therethrough, said gripping member being pivotally mounted to assume a first angular relation to the elongated member so as to provide positive gripping engagement between the elongated member and edge portions of said opening in said insert member when said gripping member is moved in a gripping direction and disengage the elongated member when said gripping member is moved in the opposite direction; and means for imparting relative movement between said frame and said reversible gripping means wherein pushing of the elongated member is effected when said reversible gripping means is moved in said gripping direction and pulling effected when said gripping member is shifted to reverse the gripping direction.

6. Apparatus as defined in claim 5 wherein one of said edge portions of said opening in said insert member is beveled so as to provide a surface of contact between said insert member and the elongated member when said gripping member is in said first angular relation.

7. Apparatus as defined in claim 5 wherein said gripping member comprises a pair of said insert members adjacent each other in said opening in said gripping member.

8. Apparatus as defined in claim 7 wherein the pivotal mounting of said gripping member permits it to be shifted to a substantially reversed second angular relation to the elongated member providing substantially similar positive gripping engagement between the elongated member and edge portions of said opening in each of said insert members in a direction of movement of said gripping member opposite to the direction in which such gripping engagement is provided by said gripping member in said first angular relation.

9. Apparatus as defined in claim 8 wherein one of said edge portions of the opening through each said insert member is beveled so as to provide a surface of contact between one said insert member and the elongated member when said gripping member is in said first angular relation and between the other of said insert members and the elongated member when said gripping member is in said second angular relation.

* * * * *